US006263983B1

(12) United States Patent
Wentworth et al.

(10) Patent No.: US 6,263,983 B1
(45) Date of Patent: Jul. 24, 2001

(54) APPARATUS FOR DIRECTIONAL DRILLING

(75) Inventors: Steven W. Wentworth, Brookfield; Robert F. Crane, Oconomowoc, both of WI (US)

(73) Assignee: Earth Tool Company, L.L.C., Oconomowoc, WI (US)

( * ) Notice: Subject to any disclaimer, the term of this patent is extended or adjusted under 35 U.S.C. 154(b) by 0 days.

(21) Appl. No.: 09/373,395

(22) Filed: Aug. 12, 1999

Related U.S. Application Data

(63) Continuation-in-part of application No. 09/212,042, filed on Dec. 15, 1998, now Pat. No. 6,148,935.

(60) Provisional application No. 60/097,694, filed on Aug. 24, 1998.

(51) Int. Cl.[7] ..... E21B 10/00

(52) U.S. Cl. ..... 175/19; 166/242.6; 175/61; 175/376; 175/398

(58) Field of Search ..... 125/19, 61, 62, 125/376, 378, 399, 400, 320, 45, 398; 166/255.2, 242.6

(56) References Cited

U.S. PATENT DOCUMENTS

| | | | | |
|---|---|---|---|---|
| Re. 33,793 | | 1/1992 | Cherrington et al. | 175/61 |
| 4,281,726 | * | 8/1981 | Garrett | 175/321 |
| 4,694,913 | | 9/1987 | McDonald et al. | 175/61 |
| 4,784,230 | | 11/1988 | Cherrington et al. | 175/61 |
| 4,907,658 | | 3/1990 | Stangl et al. | 175/19 |
| 4,945,999 | | 8/1990 | Malzahn | 175/19 |
| 4,953,638 | | 9/1990 | Dunn | 175/61 |
| 5,070,948 | | 12/1991 | Malzahn et al. | 175/19 |
| 5,148,880 | | 9/1992 | Lee et al. | 175/393 |
| 5,242,026 | | 9/1993 | Deken et al. | 175/62 |
| 5,253,721 | | 10/1993 | Lee | 175/73 |
| 5,633,589 | | 5/1997 | Mercer | 324/326 |
| 5,647,448 | | 7/1997 | Skaggs | 175/421 |
| 5,778,991 | | 7/1998 | Runquist et al. | 175/61 |
| 5,795,991 | | 8/1998 | Hesse et al. | 73/12.09 |
| 5,799,740 | | 9/1998 | Stephenson et al. | 175/62 |
| 5,899,283 | | 5/1999 | Cox | 175/376 |
| 6,109,371 | * | 8/2000 | Kinnan | 175/61 |
| 6,148,935 | * | 11/2000 | Wentworth et al. | 175/398 |

OTHER PUBLICATIONS

Geological Boring Advertisements for Sonde Housing; Duro Spade; Quick Steer; Bog–Hog Conical Steering Head; Sonde Housing Combination; and Black Reamer;, Vermeer—Illinois, Inc., 6 pages.

Spirol Coiled Pins brochure, Spirol International Corporation, Feb., 1997, 14 pages.

* cited by examiner

*Primary Examiner*—William Neuder

(74) *Attorney, Agent, or Firm*—Philip G. Meyers; Philip G. Meyers Intellectual Property Law, P.C.

(57) ABSTRACT

The invention provides an improved apparatus for directional boring and in particular an improved system for boring through hard and rocky substrates frequently encountered when boring under obstacles such as roadways. According to one aspect of the invention, a directional drilling apparatus includes a drilling head having a front face angled relative to the lengthwise axis of the tool and configured for steering the drilling apparatus, a housing having an internal chamber for mounting an electronic locating device therein rearwardly of the drilling head for transmitting a signal indicating the orientation of the angled face of the drilling head, and a joint at which the drilling head is removably mounted to the housing of the locating device. The joint includes a splined connection for passing torque from the sonde housing to the bit and an interlock mechanism which mechanically secures the bit to the sonde housing in a manner permitting the bit to be manually removed from the housing without undue difficulty.

19 Claims, 6 Drawing Sheets

APPARATUS FOR DIRECTIONAL DRILLING

CROSS-REFERENCE TO RELATED APPLICATIONS

This application is a conversion from U.S. Provisional Application Ser. No. 60/097,694, filed Aug. 24, 1998, and relied upon for priority and a continuation in part of U.S. Ser. No. 09/212,042, filed Dec. 15, 1998, U.S. Pat. No. 6,148,935.

TECHNICAL FIELD

The invention relates to a method and apparatus for directional boring in rocky formations using an onboard sonde for controlling the direction of the bore.

BACKGROUND OF THE INVENTION

Directional boring apparatus or trenchless drills for making holes through soil are well known. The directional borer generally includes a series of drill rods joined end to end to form a drill string. The drill string is pushed or pulled though the soil by means of a powerful device such as a hydraulic cylinder. See McDonald et al. U.S. Pat. No. 4,694,913, Malzahn, U.S. Pat. Nos. 4,945,999 and 5,070,848, and Cherrington, U.S. Pat. No. 4,697,775 (U.S. Pat. No. RE 33,793). The drill string may be pushed and rotated at the same time as described in Dunn, U.S. Pat. No. 4,953,633 and Deken, et al., U.S. Pat. No. 5,242,026. A spade, bit or head having one or more angled faces configured for boring is disposed at the end of the drill string and may include an ejection nozzle for water or drilling mud to assist in boring.

In one known directional boring system, the drill bit is pushed through the soil without rotation in order to steer the tool by means of the angled face, which is typically a forwardly facing sloped surface. For rocky conditions, a row of teeth may be added to the drill bit and the bit operated in the manner described in Runquist et al. U.S. Pat. No. 5,778,991. Other toothed bits for directional boring through rock are shown in European Patent Applications Nos. EP 0 857 852 and EP 0 857 853, Cox U.S. Pat. No. 5,899,283, Skaggs U.S. Pat. No. 5,647,448 and Stephenson U.S. Pat. No. 5,799,740. Steering systems for use with these devices require keeping track of the angle of rotation of the sloped face of the bit and/or the teeth.

According to another known system, a transmitter or sonde mounted in a tubular housing is mounted behind and adjacent to the bit and sends a signal that indicates the angle of rotation of the bit. The sonde is mounted in a predetermined alignment relative to the steering portion of the bit. Since the sonde housing is generally made of steel, a series of longitudinal slots or windows are provided through the wall of the sonde housing to permit transmission of the signal. See generally Mercer U.S. Pat. Nos. 5,155,442, 5,337,002, 5,444,382 and 5,633,589, Hesse et al. U.S. Pat. No. 5,795,991, and Stangl et al. U.S. Pat. No. 4,907,658. Mounting of the sonde in its housing has been accomplished by end loading as illustrated by the foregoing patent to Stangl et al. or through a side opening which is closed by a door or cover during use, as illustrated in Lee et al. U.S. Pat. Nos. 5,148,880 and 5,253,721.

Prior attempts to use sondes in horizontal directional boring apparatus, particularly of the type for drilling consolidated rock formations, have proven less than ideal. Breakage of the sonde is to be avoided because sondes are difficult and expensive to replace. The sonde housing cover in side-loading sonde housings is prone to failure. The bolts used to secure the cover often loosen or break off as a result of the abrasion and stress applied to the sonde housing during boring, and the door or cover may work loose or collapse inwardly, crushing the sonde. A need remains for a more secure side-loading sonde housing which is nonetheless easy to open and close when necessary.

A need also persists for a directional boring system specifically adapted to horizontal boring through rocky formations, i.e., wherein the drilling head efficiently bores through consolidated rock formations which ordinary duckbill type bits are unable to penetrate. This can be particularly troublesome when mixed conditions are encountered during a bore, for example, the first portion of the bore is made through soft soil, but an unexpected rock formation is encountered. The connection between the bit and sonde housing should pass torque without undue strain, resist the unavoidable abrasion of surface metal that occurs during use, and yet readily permit disconnection, such as at the terminal end of a bore, at which point the drilling head (including both sonde housing and bit) is typically removed so that the drill string can be used to pull a pipeline back through the completed bore as it withdraws.

Threaded connections between the bit and the sonde housing are secure and shielded from abrasion, but difficult to disengage manually due to the high torque applied to the bit during operation. Bolts used to attach the bit to a sonde housing are exposed to abrasion and tend to loosen. It is also desirable to provide a bit which can be rebuilt and used several times, doubling or tripling the service life of the unit. The present invention addresses these concerns.

SUMMARY OF THE INVENTION

The present invention provides an improved apparatus for directional boring and in particular an improved system for boring through hard and rocky substrates frequently encountered when boring under obstacles such as roadways. According to one aspect of the invention, a directional drilling apparatus includes a drilling head having a front face angled relative to the lengthwise axis of the tool and configured for steering the drilling apparatus, a housing having an internal chamber for mounting an electronic locating device therein rearwardly of the drilling head for transmitting a signal indicating the orientation of the angled face of the drilling head, and a joint at which the drilling head is removably mounted to the housing of the locating device. The joint includes a splined connection for passing torque from the sonde housing to the bit and an interlock mechanism which mechanically secures the bit to the sonde housing in a manner permitting the bit to be manually removed from the housing without undue difficulty.

According to a preferred form of the invention, the interlock mechanism includes a projection, which may be the front end of the sonde housing or the rear end of the bit, and a socket into which the projection closely fits, which socket is formed on the other of the front end of the sonde housing or the rear end of the bit. The projection has a first opening having a lengthwise axis which lies in a plane substantially perpendicular to the axis of rotation of the drilling head, and a wall defining the socket has a second opening therein having a lengthwise axis which lies in a plane substantially perpendicular to the axis of rotation of the drilling head and which is brought into alignment (or near alignment, as described hereafter) with the first opening when the projection is fully inserted into the socket. A retainer is sized for insertion into the aligned openings. The retainer is preferably a pin or generally tubular insert that can be compressed from a relaxed state diameter to a retaining diameter at which an outer circumferential surface of the retainer tightly engages inner surfaces of the openings and holds the bit in engagement with the sonde housing.

The splined connection between the bit and the sonde housing preferably includes a series of longitudinal, spaced splines in one of the rear end of the bit or the front end of the sonde housing, and a corresponding series of longitudinal, spaced grooves in the other of the rear end of the bit or the front end of the sonde housing. Since the bit and housing must be keyed to one another so that the position of the sonde is in a known alignment relative to the cutting face of the bit, a master spline and groove are preferably provided so that the bit and sonde housing fit together in one predetermined alignment. As described hereafter, the splines may be provided on the outside of the projection, and the grooves may be provided on the inside of the socket.

According to a preferred form of the invention, the improved joint comprises a projection extending from a front end portion of the locating device housing, which projection has a series of longitudinal, spaced splines thereon. The projection has a longitudinal axis which is offset from a longitudinal axis of rotation of the drilling head. A rearwardly opening socket formed in the drilling head has longitudinal, spaced grooves configured to receive the splines of the projection therein. A keying mechanism, such as the master spline and groove combination described above, is provided on the projection and the socket to permit insertion of the projection into the socket only in one (or a limited number of) predetermined orientations. Openings in the socket and projection are configured to receive a removable retainer, such as a rolled pin, for mechanically interlocking the projection in the socket with the splines of the projection inserted into corresponding grooves of the socket. Such a joint according to the invention is protected from abrasion because of its location away from the outer periphery of the head, provides a strong connection due to the substantial length and width of the splines, yet can be taken apart easily by manually removing the retaining pins.

In another aspect, the invention provides a cutting head with a plurality of cutting teeth raked into the cut of the drilling head. Such teeth are oriented at an angle of at least about 30 degrees relative to an imaginary line normal to an arcuate front surface of the cutting head from which the cutting teeth project. Such an arrangement provides the desired shear cutting force against the rock face while simultaneously reducing the shock and vibration applied to sonde housing and the drill string. Preferred teeth for cutting rock according to the invention comprise a cylindrical base into which a carbide cutting tip is press-fitted or preferably brazed. These rock cutting teeth preferably have sufficient strength and width to survive and protect the tip from breaking away, plus sufficient length to project beyond the diameter of the brow, so that the teeth and not the body of the bit does the cutting. In a preferred embodiment, a small carbide rod can be inserted behind the tip to act as a back-up tooth when the carbide tip breaks away, as described further below. The cutting teeth are readily replaceable by tapping a used tooth out from behind using rearwardly opening tap-out holes provided for that purpose.

An improved drilling bit according to the invention may further incorporate a rear, frustoconical crushing surface that defines a space or zone crescent-shaped in cross-section that narrows from front to rear. The crescent-shaped crushing zone extends nearly 360 degrees and is configured for crushing rock fragments torn loose by the cutting teeth mounted on the front of the bit. The rear portion of the bit defining the crushing zone is free of large rounded projections that tend to cause loose stones and fragments in the crushing zone to bounce around, rather than be drawn into the narrowing end of the crescent for crushing.

The invention further includes an improved tooth for use on a rock drilling bit. Such a tooth includes a generally cylindrical tooth holder having a first frontwardly opening hole and a second frontwardly opening hole behind the first hole. A first cutting tip fits to a predetermined depth in the first hole. A second cutting tip fits to a predetermined depth in the second hole, such that the second cutting tip is positioned behind the first cutting tip. The second tip preferably is a separate piece from the first, and may have a smaller diameter than the first tooth such that it has a lower cost but is suitable for finishing a bore in progress when the first tooth breaks off.

In another aspect, the invention provides an apparatus for mounting an electronic device therein for use in an underground boring machine. Such an apparatus includes an elongated housing having means at opposite ends of the housing for connecting the housing to other components of the boring machine and an elongated internal chamber configured to receive an electronic device such as a sonde therein and having an elongated access opening which extends along an exterior surface of the housing. A cover sized to close the access opening has edges that fit beneath one or more flanges of the housing. A retainer such as a roll pin is sized for insertion into openings in the cover and housing, which openings become aligned when the cover is positioned with the edges beneath the flange of the housing. The retainer can be compressed from a relaxed state diameter to a retaining diameter at which an outer circumferential surface of the retainer tightly engages inner surfaces of the openings and holds the first part in engagement with the second part.

According to a preferred embodiment, the access opening has a recessed rim including a pair of elongated sides and a pair of ends spanning the sides, each side including a step on which the cover rests when its covers the access opening, and a pair of laterally inwardly extending rim flanges on opposite sides of the access opening each having a pair of inclined undersurfaces, which undersurfaces taper in a direction laterally inwardly and upwardly away from the step. The cover has a pair of laterally outwardly extending cover flanges on opposite side edges of the cover, which cover flanges taper in a direction laterally outwardly and downwardly so that the cover flanges mate slidingly with the undersurfaces of the rim flanges, whereby upon placement of the cover into engagement with the step in a first position wherein the cover flanges and the rim flanges are offset, the cover may then slide in a lengthwise direction so that the cover assumes a second position wherein the cover flanges underlie the rim flanges and at which second position the means for releasably securing the cover may be engaged.

An improved sonde housing according to the invention makes use of strategically positioned hard, wear-resistant studs to protect the body of the sonde housing from abrasion. Such studs have been previously used on cutting bits, but the benefits of using studs on the sonde housing have not been appreciated. In particular, placement of studs on the top face of the housing and optionally in a pair of annular formations near the front and rear ends of the housing improve the service life of the housing. In one aspect, a sonde housing configured for mounting a sonde therein comprises a cylindrical steel body have a sonde-receiving recess therein. A portion of the sonde housing body that receives a reaction force from a cutting bit has a series of hard, wear resistant studs mounted thereon effective to reduce wear on the portion of the sonde housing body that receives the reaction force. In another aspect, portions of the sonde housing body proximate opposite ends of the body have hard, wear resistant studs mounted thereon effective to reduce wear on end portions of the sonde housing body.

A further feature of the invention provides a coupling for a connecting two parts of a machine that rotates about an axis of rotation in use. Such a coupling comprises a first part of the machine that rotates in use, which first part has an first opening having a lengthwise axis which lies in a plane substantially perpendicular to the axis of rotation of the machine, a second part of the machine that rotates in use, which second part has a second opening therein having a lengthwise axis which lies in a plane substantially perpendicular to the axis of rotation of the machine and which is brought into alignment with the first opening when the first part is disposed next to the second part, and a retainer such as a roll pin which is sized for insertion into the aligned openings, wherein the retainer can be compressed from a greater relaxed state to a retaining diameter at which an outer circumferential surface of the retainer tightly engages inner surfaces of the openings and holds the first part in engagement with the second part. Such a coupling can maintain the two machine parts, such as a bit-sonde housing or sonde housing-starter rod, in mechanical engagement even without use of splines for passing torque. The recessed position of the resilient retainer during use shields it from surface abrasion, a common failure mode for bolts and other fasteners that must present an outwardly facing head. These and other aspects of the invention are described in detail below.

BRIEF DESCRIPTION OF THE DRAWINGS

In the accompanying drawings, wherein like numerals denote like elements.

Figure 1:
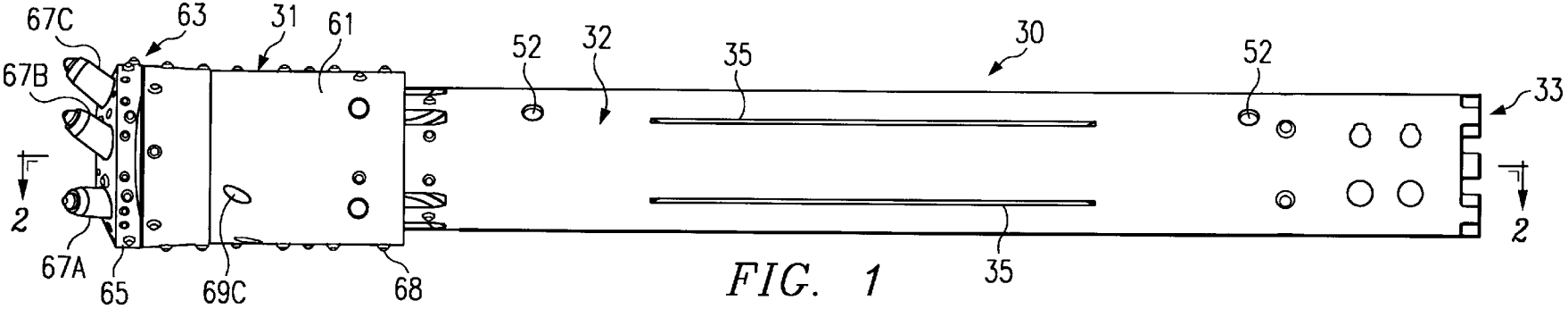
FIG. 1 is a bottom view of a drill head according to the invention.

While the making and using of various embodiments of the present invention are discussed in detail below, it should be appreciated that the present invention provides many applicable inventive concepts which can be embodied in a wide variety of contexts. The embodiments discussed herein are merely illustrative of specific ways to make and use the invention and do not limit the scope of the invention.

DETAILED DESCRIPTION OF THE INVENTION

Referring now to FIGS. 1 to 7, a drill head 30 according to the invention for use in a directional drilling apparatus includes a drill bit 31 removably mounted on the front end of a generally cylindrical sonde housing 32. A rear end socket 33 of housing 32 is configured for connection to a corresponding projection forming part of a starter rod at the terminal end of a drill string. Details of this splined joint are described in U.S. Ser. No. 09/212,042 filed Dec. 15, 1998, the entire contents of which are incorporated by reference herein. The same splined joint may be used at the front end of sonde housing 32 as an alternative to the connection described hereafter. An internal flow passage 34 extends along the length of housing 32 from socket 33 to a front end face of housing 32 in order to conduct drilling mud or water to the bit, the use of which is well known in the art.

Sonde housing 32 has a lengthwise, laterally-opening sonde cavity 36 which is closed in use by a removable cover 37. Cavity 36 has a centered, rearwardly-facing L-shaped key 38 which engages a corresponding groove in the end of the conventional cylindrical sonde to securely position the sonde in the cavity 36 in a predetermined alignment relative to the cutting teeth 67 of bit 31 as described hereafter. Since drill head 30 is generally made of steel, it is necessary to provide a series of spaced, thin longitudinal slots 35 in housing 32 and cover 37 to that the signal from the sonde can be detected from the ground surface.

Cover 37 includes two (or more) pairs of longitudinally extending wings 39 extending laterally from the lengthwise axis of cover 37. Wings 39 matingly fit through lateral recesses 42 in a rim 43 of sonde housing 32, and then cover 37 slides rearwardly in the embodiment shown so that wings 39 slide beneath adjoining portions of rim 43 into grooves 44

Figure 12:
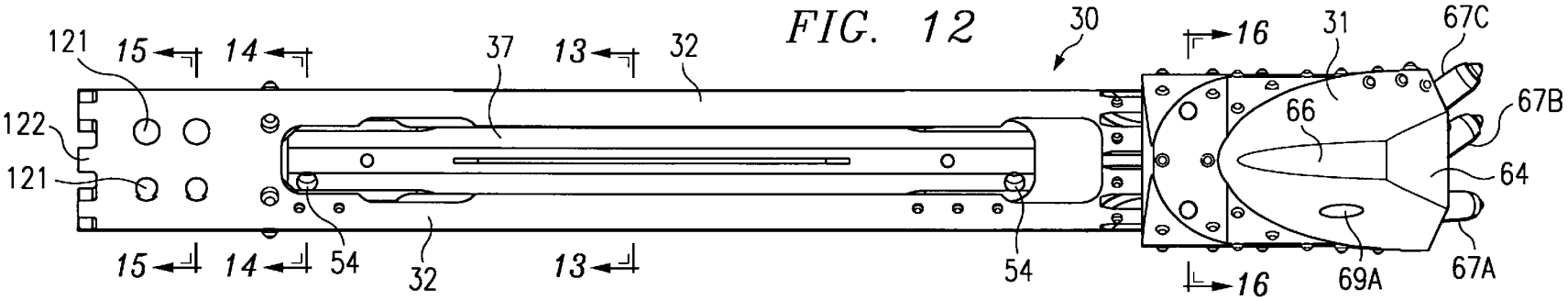
FIG. 12 is a top view of the drill head shown in FIG. 1, with the sonde cover in place.
Figure 13:
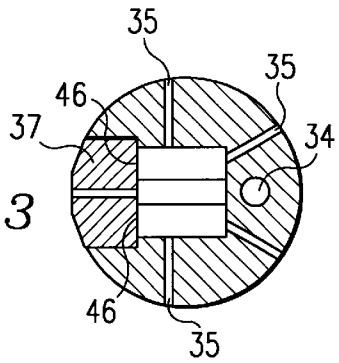
FIG. 13 is a cross sectional view taken along the line 13—13 in FIG. 12.
Figure 15:
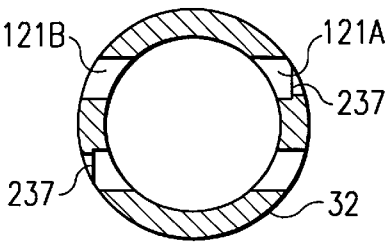
FIG. 15 is a cross sectional view taken along the line 15—15 in FIG. 12.
Figure 14:
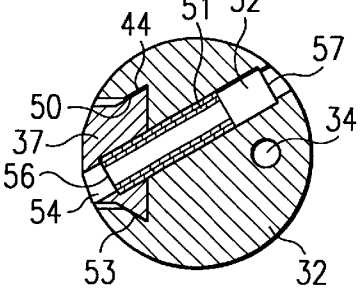
FIG. 14 is a cross sectional view taken along the line 14—14 in FIG. 12.

(see FIGS. 12–14.) It is preferred to provide at least two pairs of wings 39 at opposite ends of cover 37 in order to provide enhanced holding action. A third pair of wings and corresponding openings 42 may be located along the middle of cover 37 if desired. It is important that wings 39 have substantial length and thickness so that premature failure does not occur. Preferably, wings 39 extend at least about 10% of the total length of cover 37, preferably from about 15% to 40% thereof, and have an outwardly tapering, dovetailed shape in cross section (FIGS. 6, 14) which matches an undercut profile of grooves 44.

Cover 37 is typically made of steel but is nonetheless subject to severe torque during use. To prevent cover 37 from collapsing inwardly, it is best to support cover 37 along the entirely of its sides, rather than rely solely on lateral wings for support. Cavity 36 has a pair of longitudinal shelves 46 which are coplanar with each other and with a pair of end shelves 47 which lie beyond opposite ends of a sonde-receiving recess 48. Shelves 46, 47 provide the support needed to prevent inward collapse of cover 37 in all but the most extreme conditions.

To further protect the sonde as it rests in recess 48, the ends of the sonde recess may be filled with a flowable compound such as a soft elastomer having a durometer in the range of about 10 to 20 on the Shore A scale. A urethane elastomer has proven most effective because it has a high chemical resistance to conventional drilling mud. After installation of the sonde onto key 38, the flowable compound is poured in and set or cured to form a pair of resilient shock absorbers that conform to the space around the sonde and protect it from shocks and vibrations. The compound may be filled into the ends only, for example, to the dotted lines shown in FIG. 7, filling in front rounded, rearwardly facing recesses 45A ahead of the sonde and rear rounded, frontwardly facing recesses 45B behind to a level just slightly beyond and covering the front face of key 38 (e.g., 0.05 inch) and to the same level on rear sonde holding projection 49. In the alternative, the compound can fill entirety of recess 48, and in any case does not hinder transmission of the sonde signal or removal of the sonde when necessary. The surface of cover 37 should be free of studs, since this would place undue stress on the cover.

The use of bolts to secure cover 37 is of course feasible, but bolts tend to loosen or break off during use. Use of a bolt head to hold the cover down is not preferred because the head of the bolt, which creates the clamping force, is necessarily located on the outside of the device and little can be done to protect it from abrasion. Accordingly, as the fasteners used to removably secure cover 37 to housing 32, it is preferred to use retainers 51 in the form of spiral-wound roll pins or a series of nested, split (C-) rings of the type which resiliently engage the walls of a mounting hole once inserted. Even a high-strength plastic rod, tubular or solid, could be used for retainer 51. A preferred roll pin comprises a steel sheet having a thickness in the range of about 1/32–1/8 or 1/16–1/8 inch, a length of 2–4 inches, and a diameter in the range of about 7/16 to 5/8 inch, more generally 7/16 to 1 inch, and which has been spiral wound at least about one and one-half times, generally at least two times so as to provide a doubled thickness. It has been found surprisingly that such retainers remain in place in the rapidly spinning drill head even when no stop is provided in the direction of rotation, yet can be removed manually with a hammer and pin. This type of retainer is also used to connect the sonde housing 32 to the starter rod, as noted above, and to connect the bit 31 to housing 32 as described hereafter.

As illustrated in FIGS. 12 and 14, a pair of spaced, parallel, transverse holes 52 are provided in sonde housing 32 which open on the rear surface of housing 32 and on end shelves 47 thereof. Holes 52 preferably have axes slightly offset from a lengthwise axis A1 of housing 32 and emerge at an acute angle relative to flat shelves 47. Similarly, angled holes 54 in cover 37 align with holes 52 when cover 37 slides to its closed position, whereupon roll pins 51 are inserted to prevent cover 37 from sliding back to its original position until pins 51 are removed, such as by tapping them out from behind in the opposite direction from the direction of insertion. In the embodiment illustrated, roll pins 51 are confined for sliding movement between a pair of stops (annular steps) 56, 57 provided in the walls of holes 52, 54, respectively. Pins 51 have a length slightly less than the length of the longer hole 52, so that tapping with a chisel or rod from hole 54 drives pin 51 against step 57 to a position at which cover 37 can slide away, and tapping from the opposite side drives it against step 56 to a position as which cover 37 is locked from sliding. This arrangement is preferred in that pins 51 need never be completely removed and slide only a short distance between positions, making opening cover 37 much easier than with bolts.

Pins 51 and holes 52, 54 are angled as shown in order to avoid passage 34 (see FIG. 14). Otherwise, since pins 51 do not provide a hold-down or clamping force on the cover as the standard bolts used in the prior art do, holes 52, 54 could extend radially so that pins 51 would extend in a direction normal to the outer surface of cover 37 when installed. Mechanical engagement of wings 39 with corresponding inclined undersurfaces 50 of grooves 44 holds the cover down, and pins 51 act only to prevent cover 37 from sliding back in a lengthwise direction.

Figure 7:
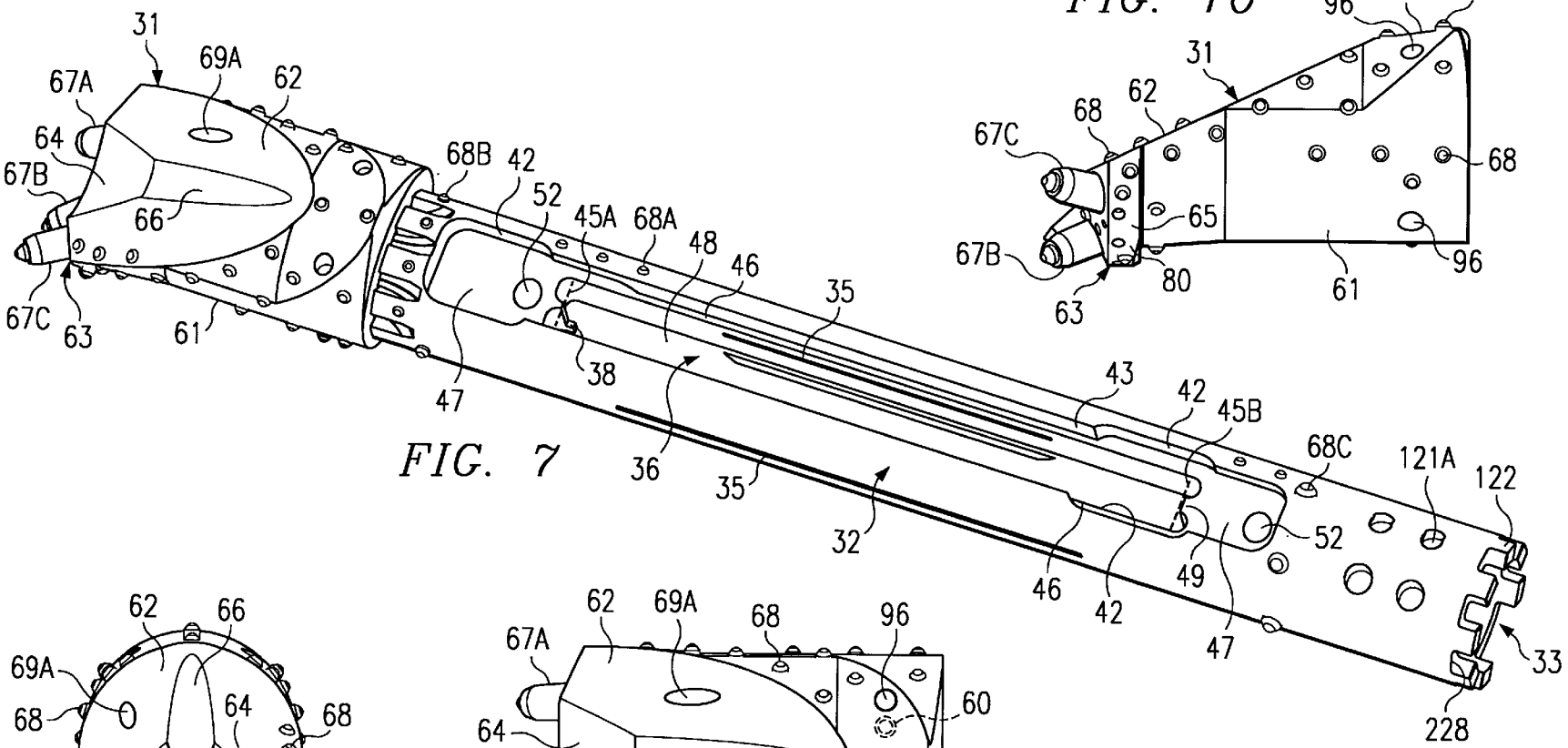
FIG. 7 is a perspective view of the drill head of FIG. 1, with the sonde cover removed to show the sonde compartment.
Figure 9:
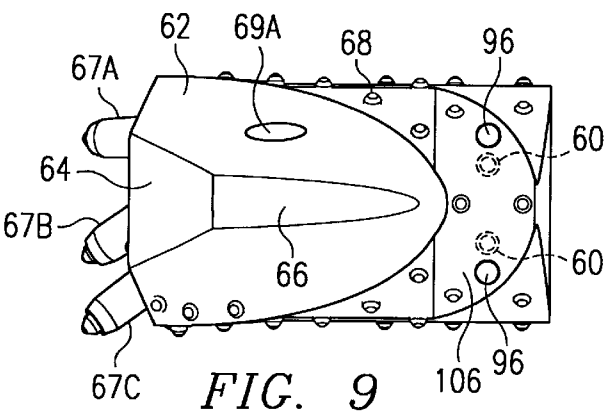
FIG. 9 is a top view of the drill bit shown in FIG. 7.
Figure 8:
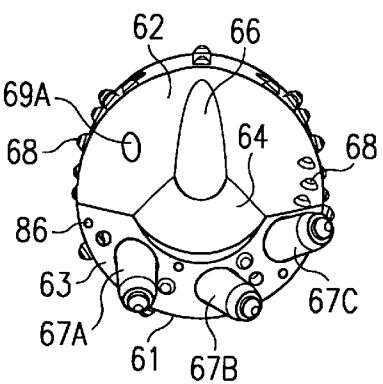
FIG. 8 is a front view of the drill bit shown in FIG. 7.

Referring to FIG. 7, carbide studs 68 are preferably deployed on sonde housing 32 in strategic locations to reduce wear on the base metal. In particular, a lengthwise row of studs 68A is placed on the top surface of housing 32 opposite the primary cutting teeth 67 because reaction force from the teeth 67 tends to produce high wear in this area. Placement of studs along the periphery of rim 43 also reduces wear to cover 37. It is also desirable to provide an annular formation of studs 68B to protect the associated joint (splines) on the front end of housing 32, and a further annular group of equiangular studs 68C to provide similar protection for the rear joint connecting housing 32 to the starter rod.

Referring now to FIGS. 8–12 and 16–22, drill bit 31 of the invention is illustrated in detail. Bit 31 preferably comprises a cut-away cylindrical body with a generally semi-cylindrical bottom section 61, a flat, angled top face 62 which slopes forwardly and across the tool axis A1 at an angle in the range from about 8 to 35 degrees relative to the tool axis A1 (25° as shown), and a nose section 63. Numerous rounded tungsten carbide studs 68 are distributed over the surface of bit 31 as shown. Carbides 68 serve a two-fold purpose of grinding cuttings passed back from the front of the bit 31 and protecting the surface bit 31 from excessive abrasion during use. Carbides are typically interference fitted into apertures 58 in head 30, or may be brazed therein.

Face 62 can be used to steer head 30 through dirt by forward thrust without rotation in a manner known in the art, and when drilling in rocky conditions (forward thrust with rotation), can serve to guide the bit along a shelf as generally described in Runquist et al. U.S. Pat. No. 5,778,991, issued Jul. 14, 1998, and discussed further below. Face 62 has a pair of first and second central, forwardly flaring grooves 64, 66 each of circular cross section (frustoconical) for channeling cuttings rearwardly from the head. First groove 64 is preferably deeper and flares more widely than second groove 66, which is positioned such that cuttings are funneled to it by groove 64.

Nose section 63 includes a radially extending, arc-shaped rim or flange 65 on which three large cutting teeth 67A, 67B, 67C are mounted so that the cutting ends thereof extend outwardly beyond the outer diameter of the bit body. Nose section 63 has three large holes 71A, 71B, 71C for receiving cutting teeth 67. Holes 71 (i.e., 71A–C, FIGS. 17–19) are evenly spaced in a generally semi-circular arc across along a front face 72 of rim 65. Carbides 68 are distributed over front face 72 and especially on an outer face 80 to protect the metal and provide increased grinding action. Holes 71 are canted at an angle of from about 30° to 60° relative to an imaginary line normal to curved front face 72 in the direction of rotation of cutting head 30. In one embodiment, the cutting teeth 67 are angled in the cutting direction at approximately 30°. The exact angle will depend in part on the slope of the conical end portions 21 of the cutting teeth, with a more tapered, sharper point requiring greater canting for the associated tooth 67 to provide the desired degree of shearing force to the formation being bored. A canting angle of less than about 30 degrees, especially 25 degrees or less, provides no significant improvement in cutting.

The cutting teeth of at least one prior art cutting head project straight from the cutting head, with the side teeth diverging slightly in opposite directions relative to the center tooth. In this configuration, the teeth of the prior art head produce a violent cutting action with the teeth bouncing onto and off of the rock being cut. It has been discovered that the resulting shock and vibration cause a higher rate of failure of the sonde and directional drilling machine. The smoother cutting action of the canted teeth 67 of the present invention reduces these problems.

Figure 19:
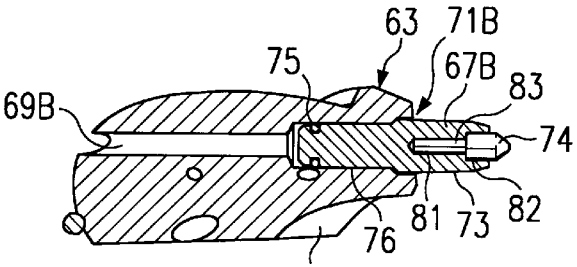
FIG. 19 is a cross sectional view taken along the line 19—19 in FIG. 17.
Figure 26:
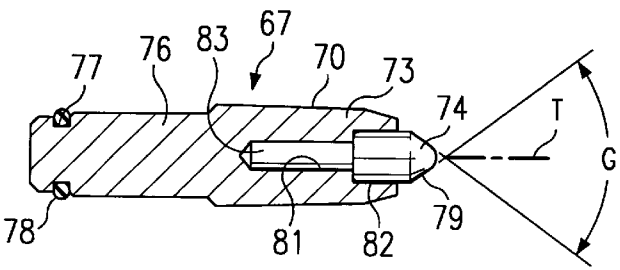
FIG. 26 is an enlarged, lengthwise sectional view of an improved cutting tooth according to the invention.

Referring to FIGS. 19 and 26, teeth 67 of the invention are specially configured for extended life and replacability. Each tooth 67 has a generally cylindrical holder 70 with a front portion 73 which has a diameter great enough to securely mount a carbide tip 74 and a rear reduced diameter portion 76 which fits into hole 71 to a predetermined depth. Holder 70 is made of a conventional steel such as a 4140 alloy. Tips 74 are preferably cylindrical pellets made of a hard, wear resistant material which is not excessively brittle, e.g. high carbon tool steel, diamond, or a ceramic such as tungsten carbide. A tungsten carbide having a Rockwell hardness on the A scale of at least about 87 is preferred. An exposed front end face 79 of tip 74 is conical and more pointed than the generally hemispherical protruding portions of grinding buttons 68. Relative to lengthwise tooth axis T, for example, conical front face 79 defines an included angle G in the range of 60° to 120°.

Rear portion 76 of tooth 67 has an outer circumferential groove 77 into which a C-spring retaining clip 78 is mounted. It is fairly common in use that tip 74 and the adjoining annular end of front portion 73 will break off, leaving only a stump of the tooth with little cutting capability. According to the invention, a secondary cylindrical recess 81 behind cylindrical recess 82 containing the base of tip 74 contains a further carbide cylindrical rod-shaped insert 83, which is preferably separate from and of smaller diameter (e.g., 25%–75%) than tip 74. When tip 74 finally breaks or wears off, insert 83 is provided to give the tooth enough cutting action to complete the bore then in progress.

Figure 18:
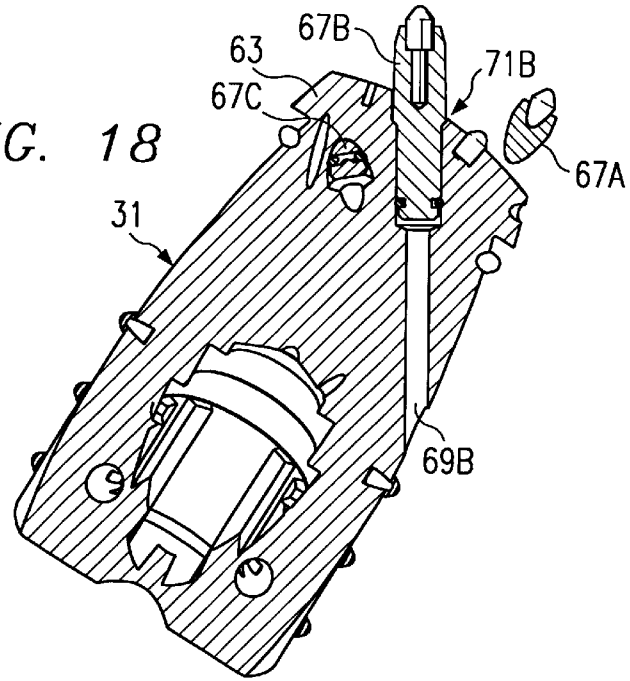
FIG. 18 is a sectional view taken along the line 18—18 in FIG. 17.
Figure 17:
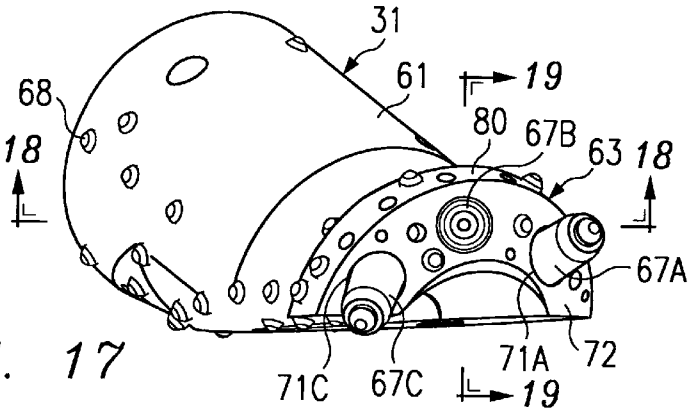
FIG. 17 is a front corner perspective view of the drill bit shown in FIG. 1.

When cutting teeth 67 are inserted into apertures 14, the C-spring retaining clips expand into a shallow corresponding annular groove 75 (only about 0.015 inch) to secure cutting teeth 67 in position. As shown in FIGS. 18 and 19, tap-out holes 69 are provided as linear, reduced diameter extensions of holes 71. When a tooth 67 must be replaced, it can be removed by insertion of a rod into hole 69 into contact with the back of tooth 67, followed by tapping the rod with a hammer until tooth 67 loosens. FIGS. 17–19 illustrate the foregoing structures for middle tooth 67B. Teeth 67A and 67C are configured in a like manner but at different positions as dictated by the geometry of bit 31.

Figure 22:
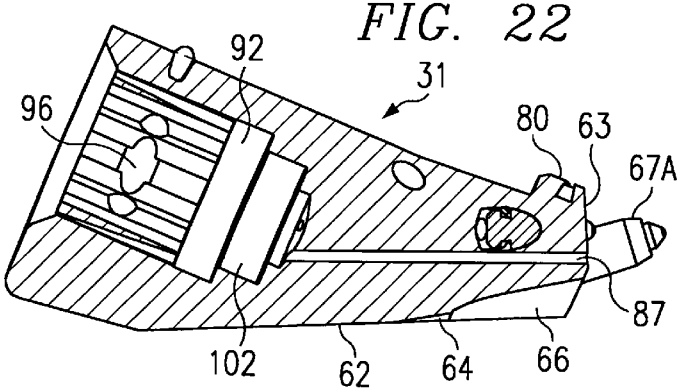
FIG. 22 is a cross sectional view taken along the line 22—22 in FIG. 20.
Figure 21:
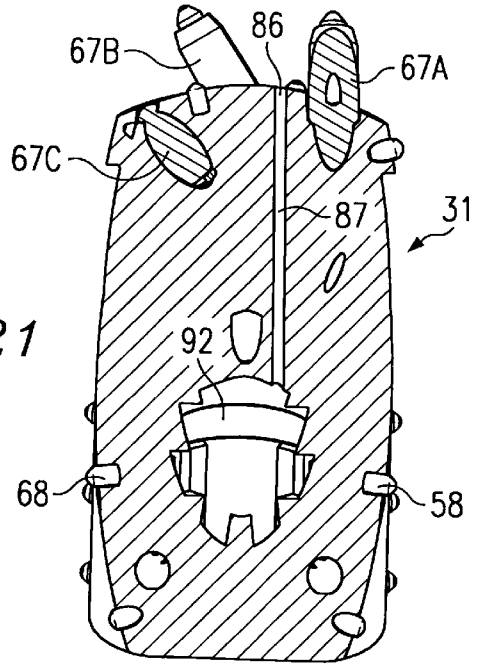
FIG. 21 is a sectional view taken along the line 21—21 in FIG. 20.
Figure 20:
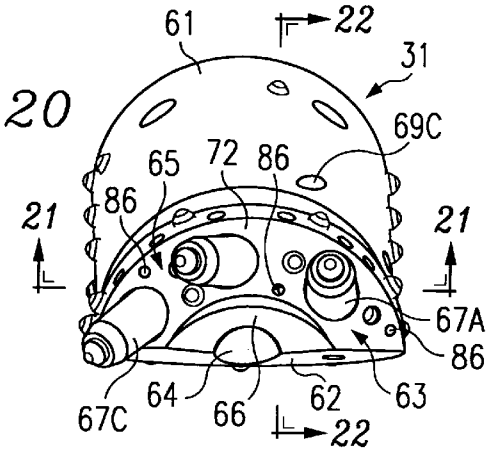
FIG. 20 is a front center perspective view of the drill bit shown in FIG. 1.

Referring to FIGS. 20–22, flange 72 of bit 31 also has a row of three fluid ejection ports 86 provided at spaced positions to provide optimum flushing action for teeth 67. Typically the fluid is a drilling mud, for example, a mixture of water, polymer and clay. The drilling mud serves to lubricate and cool the cutting head 10 and to sweep rock chips and other bored material away from the cutting head during operation. Ports 86 receive fluid from associated angled passages 87 which meet at the inner end of rear recess 92, described hereafter, and receive fluid from passage 34 (see FIG. 2). FIGS. 20–22 illustrate the foregoing structures for middle passage 86. Side ports 86 are configured in a like manner but at different positions as dictated by the geometry of bit 31. Ports 86 have a smaller diameter than conventional fluid injection outlets in order to achieve a higher velocity flow, and are positioned to the cutting side of each tooth 67A,B,C to wash cuttings from each of teeth 67.

A secure connection between bit 31 and sonde housing 32 must be provided. Typical bits or "duckbills" known in the art are bolted directly onto an angled face of the sonde housing. Since abrasion to the device occurs from the outside in, it would be more desirable to provide a connection that is partly or completely shielded from such wear, in contrast to bolts. Bolts also have relatively poor resistance to the high strain induced by drilling and often break during use.

Bit 31 is coupled to sonde housing 32 by means of a splined projection 91 provided on the front end of sonde housing 32 that fits into a corresponding rearwardly opening recess 92 in bit 31. Recess 92 is eccentrically positioned relative to the central axis of the cutting head 10. Such eccentric positioning of the coupling between the sonde housing and cutting head provides advantages in directional drilling as described hereafter.

Figure 16:
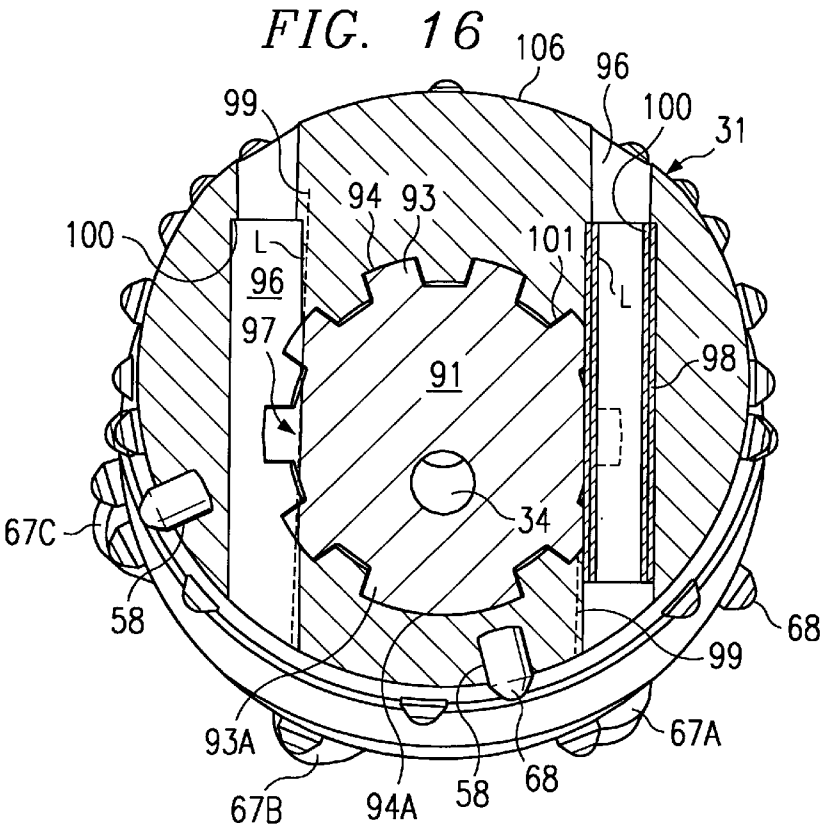
FIG. 16 is an enlarged cross sectional view taken along the line 16—16 in FIG. 12.

Splines 93 are arranged in a radial circular formation on projection 91 in the manner of gear teeth. Splines 93 are preferably elongated in the lengthwise direction of sonde housing 32 to enhance the ability of the drill string and sonde housing 32 to pass torque to the bit 31. Splines 93 are received in spline receiving grooves 94 in recess 92 as shown in FIG. 16. A widened master spline 93A is received in a corresponding master groove 94A, which are in turn in a predetermined alignment relative to key 38 so that bit 31 fits onto sonde housing 32 only in one predetermined orientation. This assures that the orientation of the sonde relative to teeth 67 is always correct. This contrasts with prior sonde housings mounted on bits by means of threaded connections, wherein slight over- or under-rotation of the bit relative to the sonde housing would cause the sonde signal to become out of alignment with the bit, leading to misdirected boring. Although, as illustrated, splined projection 91 is generally cylindrical, other geometries for splined projection 91 and recess 92 could be used. Likewise, it is within the scope of the invention to reverse parts described; in this case, the splined projection 91 would be part of bit 31 and fit into a corresponding recess in the sonde housing 32. The splines may be relocated closer to the surface of the bit as described in the sonde housing-starter rod joint described in U.S. Ser. No. 09/212,042 filed Dec. 15, 1998, incorporated by reference herein.

Figure 11:
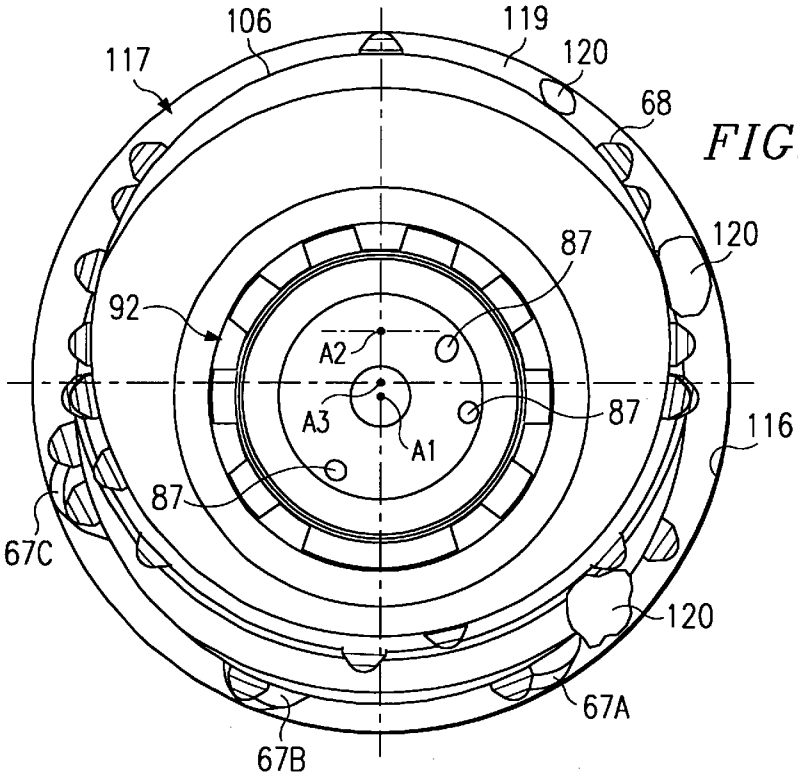
FIG. 11 is an enlarged rear view of the drill bit shown in FIG. 7, with crushing action shown schematically.
Figure 23:
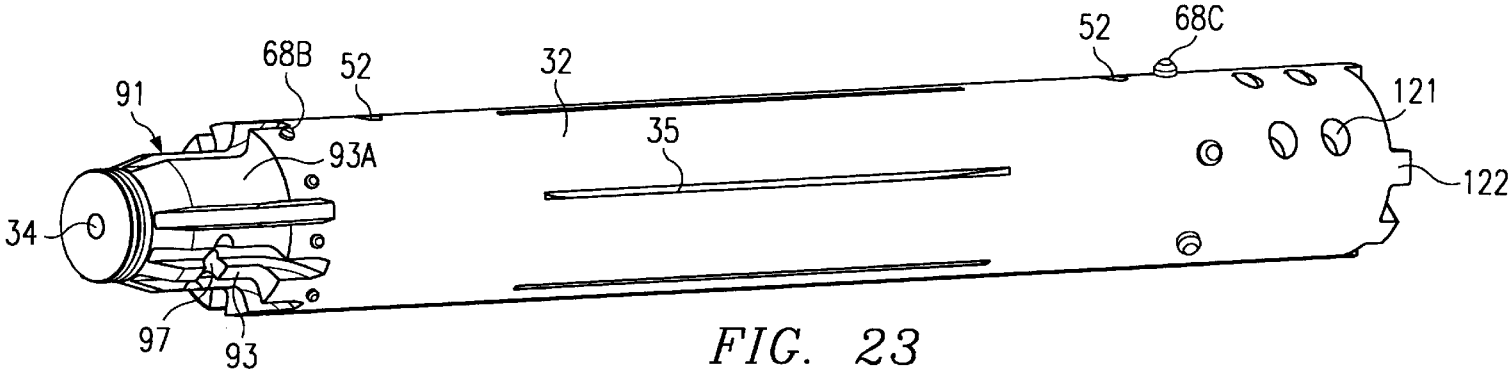
FIG. 23 is a front corner perspective view of the front end of the sonde housing shown in FIG. 1, with the drill bit removed.
Figure 24:
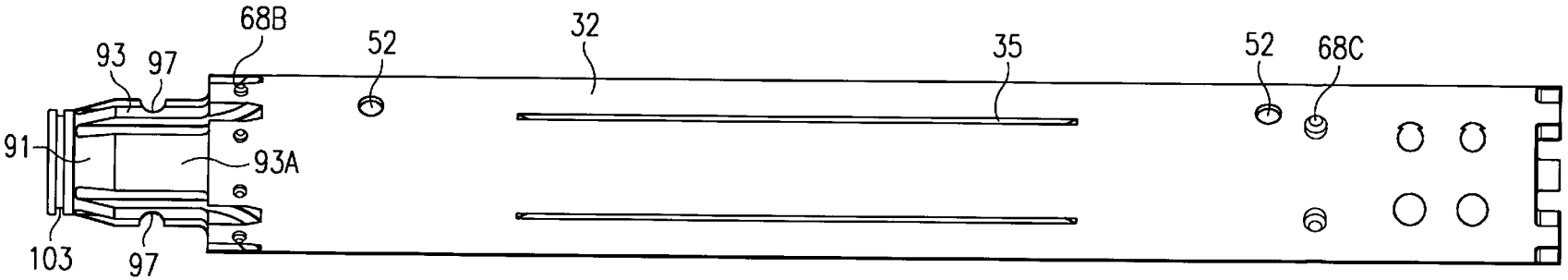
FIG. 24 is a view of the front end of the sonde housing as shown in FIG. 1, with the drill bit removed.

Bit 31 includes a pair of parallel retainer (pin) receiving holes 96 which extend in a direction perpendicular to and laterally offset from the lengthwise axis A1 of drill head 30, as shown in FIGS. 11 and 16. Preferably a pair of such holes are positioned on opposite sides of axis Al, but even a single hole 96 could be used, depending on the anticipated drilling conditions. Holes 96 intersect corresponding outwardly opening semi-circular grooves 97 on opposite sides of projection 91 (see FIGS. 16, 23, 24.)

Once fully inserted, splined projection 91 is mechanically secured in recess 92 by pins 98 inserted into holes 96. Steps 100 for preventing over-insertion may be provided near one end of each hole 96. Pins 98 are inserted at the other end of each hole 96 and reach a fully inserted position when in contact with steps 100. In one embodiment, the pins 98 are spiral-wound steel plates as described above for the sonde cover 37 that act in the manner of coil springs when inserted into holes 96 engaging the walls of holes 96 and grooves 97 and thereby remaining in place despite the violent movements of the head 31 during use. In operation, pins 98 are also disposed well within bit 31 and thus protected from surface abrasion.

Referring now to FIG. 16, grooves 97 each define an axis which is slightly skewed in a transverse (cross sectional) direction relative to the lengthwise axis of each hole 96. As indicated by the lines L drawn along the bottom of each groove 97, which are parallel to the axis of each groove 97, there will be a slight interference fit as pins 98 are inserted, tending to push the splines in a counterclockwise direction as shown. In the embodiment shown, the angle is about 1° relative to the adjoining sidewall 99 of each hole 96, and an angle of from half a degree up to about 2 degrees should be considered "slightly angled" for purposes of the invention. Insertion of pins 98 therefore preloads splines 93 in the driving direction against lead end walls 101 of the corresponding slots 94. This prevents working of the joint during boring operation that would otherwise shorten the life of the connection.

Figure 2:
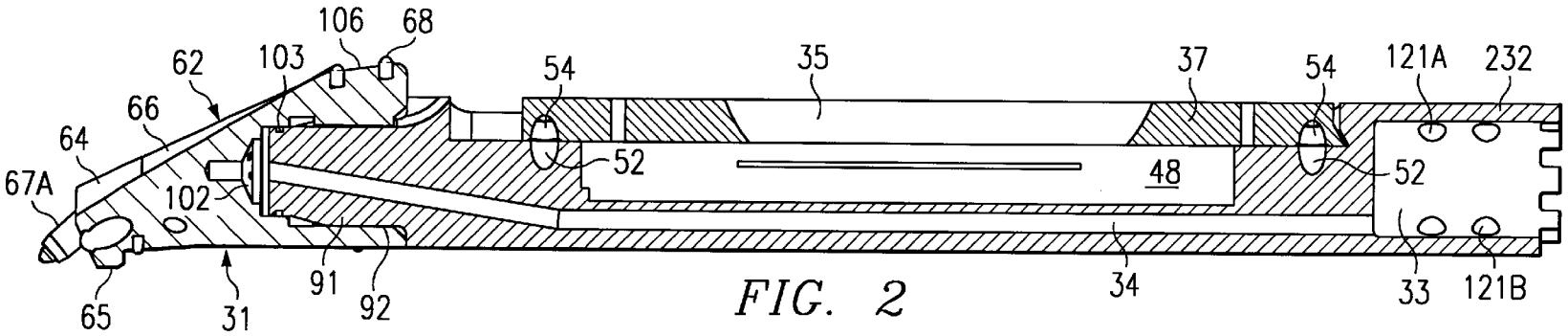
FIG. 2 is a lengthwise sectional view of the drill head along the line 2—2 in FIG. 1.
Figure 5:
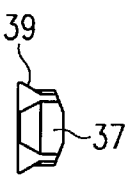
FIG. 5 is a right side end view of the cover of FIG. 3.
Figure 6:
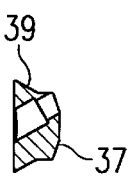
FIG. 6 is cross sectional view taken along the line 6—6 in FIG. 3.
Figure 4:
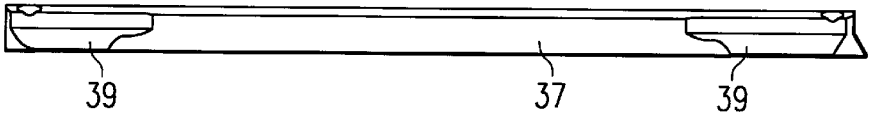
FIG. 4 is a side view of the cover of FIG. 3.
Figure 3:
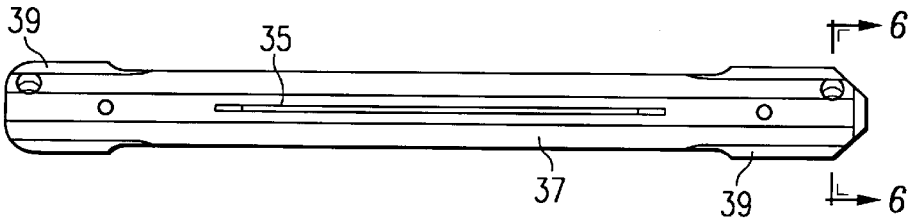
FIG. 3 is a top plan view of the cover for the sonde housing shown in FIG. 2.

When projection 91 is fully inserted and secured with pins 98 as shown in FIG. 2, clearance is provided so that the an inner, reduced diameter end portion of recess 92 forms a chamber 102 which distributes fluid from passage 34 to each of passages 87. For this purpose, a front end of projection 91 ahead of the front ends of splines 93 has am outwardly opening circumferential groove 103 (FIG. 2) wherein an 0-ring can be mounted to seal chamber 102.

Figure 10:
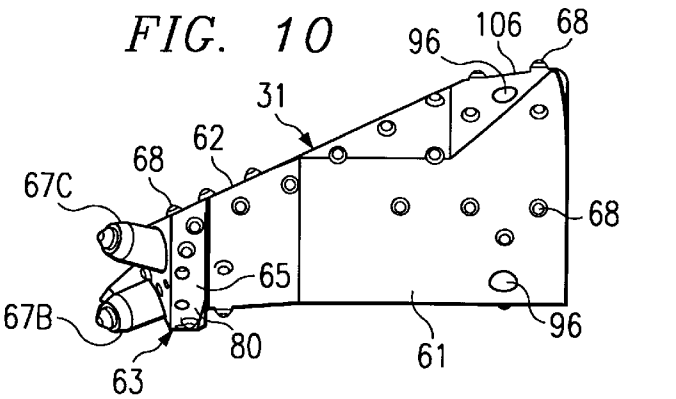
FIG. 10 is a side view of the drill bit shown in FIG. 7.

Cuttings from teeth 67 mix with the drilling mud injected from ports 86 and pass rearwardly along the outside of bit 31 under the pressure of the mud flow. Grooves 64, 66 aid in passing a large portion of the cuttings back to a crushing surface 106 on the upper rear corner of the tool opposite nose portion 62. Crushing surface 106 defines the outermost diameter of bit 31 on its top side as shown in FIG. 10, and is preferably studded with carbides 68, optionally including a pair of central, enlarged carbides 60 (see FIG. 9). In general, flow from grooves 64, 66 is directed toward crushing surface 106. Surface 106 has a semi-circular shape (its width tapers rearwardly) and slopes forwardly as shown, so that pieces of rock that pass through are gradually pulverized as the space between the wall of the borehole and surface 106 decreases.

Figure 25:
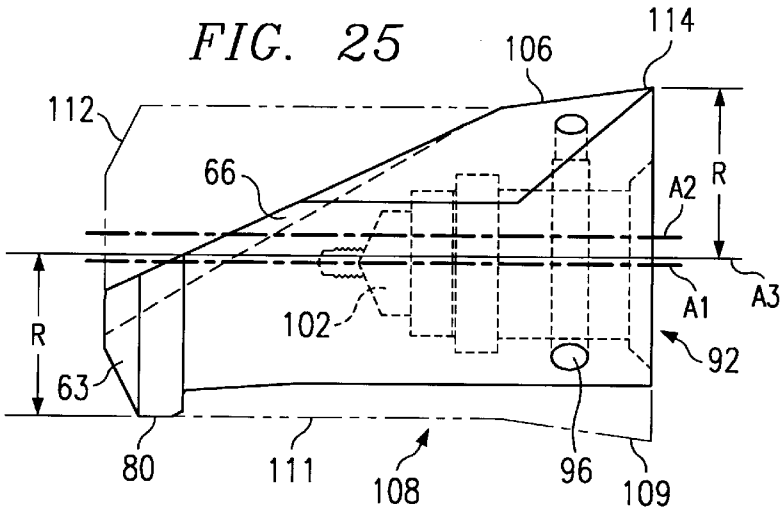
FIG. 25 is a side view, partly in phantom, of the drill bit body of the invention with teeth and carbides removed, with the original blank from which the bit body was machined shown in phantom lines.

Referring now to FIG. 25, to provide the desired configuration for the crushing surface 106, bit 31 is machined from a radially symmetrical blank 108 having a rear frustoconical portion 109 that increases in diameter in a rearward direction as illustrated, a central cylindrical portion 111, and a front frustoconical portion 112. The lengthwise axis A1 of drill head 30 coincides with the longitudinal axis of blank 220 and recess 92. A second axis A2 is established at a location parallel to and radially offset from axis A1. A crescent-shaped portion of metal is removed based on a circle centered on A2, resulting in an exterior profile rearward of nose 63 that is a composite of arcuate surfaces based on the diameters of the circles based upon axes A1 and A2. At its rear end, bit 31 has a circular cross section centered on axis A2 and thus offset from tool axis Al. The axis of rotation of A3 of head 30 is located at a point intermediate axes A1 and A2, specifically along a line equidistant from lines tangent to the points defining the maximum outer diameter of bit 31, namely a rear corner 114 at the end of crushing surface 106, and a diametrically disposed outer face or rim 80 of nose 63.

Bit 31 having the foregoing configuration provides an improved cutting action. Due to its eccentric positioning relative to the sonde housing and the smooth transition of its circular profile from back to front, bit 31 provides a crushing profile that is substantially arcuate (circular) along the entire cross-section of the borehole. As shown in FIG. 11, the resulting space between the inner surface 116 of the borehole and crushing surface 106 forms a crescent-shaped crushing zone 117. A stone or fragment 120 caught in crushing zone 117 as bit 31 rotates is forced into a gradually narrowing end 119 of the crescent which coincides with surface 106, and is thus more likely to be crushed than to bounce around inside crushing zone 117. In this manner, drill bit 31 of the invention provides a more efficient crushing action.

Referring now to FIG. 25, to provide the desired configuration for the crushing surface 106, bit 31 is machined from a radially symmetrical blank 108 having a rear frustoconical portion 109 that increases in diameter in a rearward direction as illustrated, a central cylindrical portion 111, and a front frustoconical portion 112. The lengthwise axis A1 of drill head 30 coincides with the longitudinal axis of blank 108 and recess 92. A second axis A2 is established at a location parallel to and radially offset from axis A1. A crescent-shaped portion of metal is removed based on a circle centered on A2, resulting in an exterior profile rearward of nose 63 that is a composite of arcuate surfaces based on the diameters of the circles based upon axes A1 and A2. At its rear end, bit 31 has a circular cross section centered on axis A2 and thus offset from tool axis A1. The axis of rotation of A3 of head 30 is located at a point intermediate axes A1 and A2, specifically along a line equidistant from lines tangent to the points defining the maximum outer diameter of bit 31, namely a rear corner 114 at the end of crushing surface 106, and a diametrically disposed outer face or rim 80 of nose 63.

In the above-described process, the apparatus of the invention can drill a borehole through a rocky substrate, which tunnel is curved or has several angled segments representing initial entry into the ground, horizontal boring under an obstacle such as a roadway, and upward travel towards the surface at the end of the borehole. Drill head 30 may also be used in the same manner as a convention duckbill-style bit to bore through soil or soft strata without drilling, but with reduced efficiency as compared to a boring head designed for normal push-and-turn directional boring through soil.

Other advantages of drill head 30 will be evident to those skilled in the art. Bit 31 is readily removable from sonde housing 32 by tapping out roll pins 98 from apertures 96. This allows bit 31 to be readily replaced or rebuilt when worn. For purposes of rebuilding, the generally cylindrical shape of bit 31 gives it more mass and makes it far more re-usable than toothed duckbills ("bear claws") known in the art and other bits which are essentially flat plates mounting teeth. Sonde housing 32 provides ready access to the sonde by means of cover 37, which can be readily removed and replaced, yet has sufficient strength and support from beneath to resist crushing. Roll pins 98 preferably replace conventional bolts which are highly vulnerable to loosening and breakage. The rear end of sonde housing 32 is likewise secured by retainers such as roll pins insert though holes 121 forwardly of torque-passing splines 122 into corresponding holes in a projection of the starter rod at the front end of the drill string, as described in detail in the above cited U.S. Ser. No. 09/212,042 filed Dec. 15, 1998. This permits removal of head 30 at the receiving end of the bore and replacement with a back reamer to be pulled back through the hole with the directional boring machine.

While certain embodiments of the invention have been illustrated for the purposes of this disclosure, numerous changes in the method and apparatus of the invention presented herein may be made by those skilled in the art, such changes being embodied within the scope and spirit of the present invention as defined in the appended claims.

What is claimed is:

1. In a drill head for use in a directional drilling apparatus, which drill head includes a drill bit having a portion configured for steering the drill head, a housing having an internal chamber for mounting an electronic locating device therein rearwardly of the drilling head for transmitting a signal indicating an orientation of the steering portion of the drilling head, and a joint at which the drill bit is removably mounted at the front of the drill head, the improvement wherein the joint comprises:

a projection which has a series of longitudinal, spaced splines thereon;

a socket having longitudinal, spaced grooves configured to receive the splines of the projection therein;

a keying mechanism provided on the projection and the socket which permits insertion of the projection into the socket only in one or more predetermined orientations; and openings in the socket and projection configured to receive a removable retainer for mechanically interlocking the projection in the socket with the splines of the projection inserted into corresponding grooves of the socket.

2. The drill head of claim 1, wherein the socket is formed in the drill bit and opens rearwardly.

3. The drill head of claim 2, wherein the projection extends from a front end portion of the locating device housing.

4. The drill head of claim 3, wherein the projection has a longitudinal axis which is offset from a longitudinal axis of rotation of the drilling head.

5. The drill head of claim 1, wherein the portion configured for steering the drilling apparatus comprises an angled face of the drill bit configured for steering the drill head in soil.

6. The drill head of claim 1, wherein the portion configured for steering the drilling apparatus comprises at least one frontwardly extending tooth configured for steering the drill head in rock.

7. The apparatus of claim 1, further comprising at least one pin as the retainer.

8. The apparatus of claim 7, wherein the pin is a rolled pin.

9. The apparatus of claim 1, wherein the keying mechanism permits insertion of the projection into the socket in only one predetermined orientation.

10. The apparatus of claim 1, wherein the keying mechanism comprises a master spline on the projection having a different shape than the other splines and a master groove in the socket configured to receive the master spline therein.

11. The apparatus of claim 10, wherein the openings form a through-hole extending in a direction perpendicular to the lengthwise axis of the drilling head and laterally offset therefrom so that a pin inserted therein engages splines on the projection in a manner effective to prevent withdrawal of the projection from the socket.

12. The apparatus of claim 11, wherein the keying mechanism permits insertion of the projection into the socket in only one predetermined orientation.

13. The apparatus of claim 11, wherein the openings are configured so that insertion of pins therein preloads the splines against one wall of each of the corresponding grooves of the socket, which preloading force is exerted in a driving direction when the drill head is actuated.

14. The apparatus of claim 10, wherein the master spline and groove have a different width from other splines and grooves.

15. The apparatus of claim 1, further comprising a tubular retainer which is sized for insertion into the openings, wherein the tubular retainer can be compressed from a relaxed state diameter to a retaining diameter at which an outer circumferential surface of the retainer tightly engages inner surfaces of the openings.

16. In a drill head for use in a directional drilling apparatus, which drill head includes a drill bit having a angled face configured for steering the drill head in soil, a housing having an internal chamber for mounting an electronic locating device therein rearwardly of the drilling head for transmitting a signal indicating an orientation of the steering portion of the drilling head, and a joint at which the drill bit is removably mounted at the front of the drill head, the improvement wherein the joint comprises:

a projection which has a series of longitudinal, spaced splines thereon;

a socket having longitudinal, spaced grooves configured to receive the splines of the projection therein;

a keying mechanism provided on the projection and the socket which permits insertion of the projection into the socket in only one predetermined orientation, including a master spline on the projection having a different shape than the other splines and a master groove in the socket configured to receive the master spline therein; and openings in the socket and projection configured to receive a removable pin for mechanically interlocking the projection in the socket with the splines of the projection inserted into corresponding grooves of the socket.

17. The drill head of claim 16, wherein the socket is formed in the drill bit and opens rearwardly.

18. The drill head of claim 17, wherein the projection extends from a front end portion of the locating device housing.

19. The drill head of claim 18, wherein the projection has a longitudinal axis which is offset from a longitudinal axis of rotation of the drilling head.

* * * * *